United States Patent [19]

Csathy et al.

[11] 4,188,916

[45] Feb. 19, 1980

[54] WASTE HEAT BOILER FOR ABSTRACTION OF HEAT ENERGY FROM GASEOUS EFFLUENT CONTAINING CORROSIVE CHEMICAL CONTAMINANTS

[75] Inventors: Denis G. Csathy; Wendell L. Y. Hung, both of Minneapolis, Minn.

[73] Assignee: Deltak Corporation, Minneapolis, Minn.

[21] Appl. No.: 905,598

[22] Filed: May 15, 1978

[51] Int. Cl.[2] ..... F22B 31/00

[52] U.S. Cl. ..... 122/7R; 122/DIG. 14

[58] Field of Search ..... 122/2, 7 R, 336, DIG. 14

[56] References Cited

U.S. PATENT DOCUMENTS

| | | | |
|---|---|---|---|
| 3,583,369 | 6/1971 | Trimbach et al. | 122/7 |
| 3,858,556 | 1/1975 | Terentie et al. | 122/7 |

*Primary Examiner*—Edward G. Favors

*Attorney, Agent, or Firm*—E. Eugene Kohls

[57] ABSTRACT

A waste heat boiler has an elongated horizontally oriented gas pass, a steam drum extending lengthwise of the gas pass but wholly outside the same at an elevation near but not above the roof of the gas pass. Transversely extending rows of nested water tubes which are preferably L-shaped with vertical and substantially horizontal stretches have the outer extremities of their substantially horizontal stretches joined to vertical feeder headers that extend upwardly along one side wall of the gas pass, and have the upper extremities of their vertical stretches joined to collecting headers that extend transversely across the gas pass just below its roof. The rows of tubes are arranged in groups or bundles, each held together by distributing headers and receiving headers that are separately connected with the steam drum and to which are respectively joined the feeder headers and the receiving headers. Any selected group or bundle of tubes can be lifted from the gas pass through an opening provided by removal of the section of the roof thereabove, upon disconnection from the steam drum of the distributing and receiving headers of the selected group or bundle of tubes. The described arrangement of the tubes obviates the need for the customary mud drum.

8 Claims, 6 Drawing Figures

F
8
16
33
31
34
32
A
B
C
D
7
E
11
34
2
2
4
37
9
10
23
24
26
27

34
11
37
33
30
19
7
14
4
35
36
29
10v
6
5
13
10
12
22
10h
21
23
24
27
28
38

13
15
12

WASTE HEAT BOILER FOR ABSTRACTION OF HEAT ENERGY FROM GASEOUS EFFLUENT CONTAINING CORROSIVE CHEMICAL CONTAMINANTS

This invention is concerned with the recovery of otherwise wasted heat contained in a hot gaseous medium such as the exhaust gases that emanate from many industrial plants, and has as its purpose and object to provide a waste steam generating boiler capable of usefully abstracting heat from any gaseous medium, but especially from gaseous effluents that contain a large proportion of solid particles that can cause operational problems like erosion and chemical corrosion of the heating surfaces of the boiler.

While waste heat steam generating boilers are by no means new, those heretofore available could not cope with the highly corrosive contaminants in the gaseous effluent from many industrial operations - as, for instance, the incineration of acid sludge, molten sulphur, hydrogen sulphide, any chlorinated gaseous or liquid waste, garbage and various kinds of refuse.

The gaseous effluent that results from burning waste materials such as these often contains ash-forming solid particles replete with sulphur dioxide and trioxide, or hydrogen chloride. These chemicals have an affinity for moisture and, upon combining with moisture, form a highly corrosive acid. During operation the problem posed by those contaminants is not too serious, but with prior waste heat boilers the situation was intolerable due to the sponge-like character of the bed of ash that accumulated on the mud drum in the bottom of the boilers.

It is therefore one of the objects of this invention to provide a waste heat boiler that has no mud drum, and which the bottom of the gas pass - which, as in the past, is horizontally oriented, has large unrestricted openings through which ash-forming solid particles can drop into ash bins therebelow.

Also with a view to minimizing the possibility of objectionable accumulations of corrosion producing solids on the heating surfaces of the boiler, it is another object of the invention to have all of the boiler tubes so oriented in the gas pass that they present only a minimal area of upwardly facing surfaces. As a result, almost all of the particulate solids entrained in the gaseous medium flowing through the gas pass drop through the openings in its bottom.

Another distinctive feature of this invention is that the steam drum of the boiler is entirely outside the gas pass and is so located with respect thereto that it does not obstruct the space above the gas pass. This location makes it possible to lift the boiler tubes from the gas pass in groups or bundles spaced along the length thereof, upon disconnection of the selected group or bundle from the steam drum and removal of the portion of the roof of the gas pass that lies above the selected group or bundle. As will be readily appreciated, such group-wise removability of the tubes from the gas pass has many advantages. Not only does it facilitate inspection, thorough manual cleaning and repair and replacement of any selected group of tubes without disturbing any of the others, but - as will be readily apparent to anyone experienced in the installation of boilers - it overcomes space limitations at installation sites that prohibit bringing in cranes or other lifting machines large enough to handle the entire fully assembled boiler at one time.

With these observations and objectives in mind, the manner in which the invention achieves its purpose will be appreciated from the following description and the accompanying drawings, which exemplify the invention, it being understood that changes may be made in the specific apparatus disclosed herewith without departing from the essentials of the invention set forth in the appended claims.

The accompanying drawings illustrate one complete example of the embodiment of the invention constructed according to the best mode so far devised for the practical application of the principles thereof, and in which.

Figure 5:
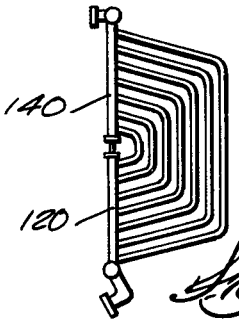
Figure 6:
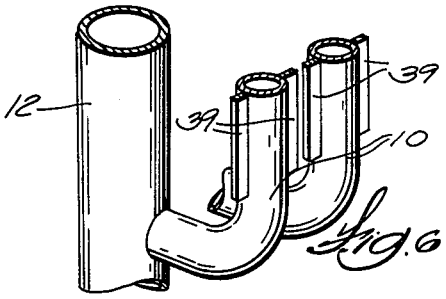

FIG. 5 diagrammatically illustrates a tube bundle in which the tubes are C-shaped; and FIG. 6 is a detail view illustrating how the water tubes can be provided with extended surface without producing potential traps for solid particles entrained in the gas stream.

Referring to the drawings, the numeral 4 designates the gas pass of the waste heat boiler which is defined by an elongated horizontally oriented casing having upright side walls 5 and 6, a roof 7 that, for a purpose to be described, consists of separately removable sections, and a bottom that is essentially open. An inlet 8 at one end of the gas pass is connectable with a source of the hot gaseous medium from which otherwise wasted heat is to be usefully abstracted, and an outlet 9 at the opposite end of the gas pass leads to a stack (not shown). Within the gas pass there is a multiplicity of water tubes 10 which form the heat exchange surfaces of the boiler and provide for indirect transfer of heat energy from the hot gases flowing through the gas pass, to boiler fluid circulating through the tubes to and from a steam drum 11 that extends for the full length of the gas pass.

A distinguishing characteristic of the invention is that the steam drum is entirely outside the gas pass. It is located at an elevation near that of the top of the gas pass but to one side thereof so as not to obstruct the space above the gas pass.

Another important feature of the invention is the absence of a mud drum, which—in a conventional boiler—presents an upwardly facing surface of considerable area on which solid particles entrained in the gaseous medium flowing through the gas pass settle. In the case of gaseous effluent emanating from waste heat sources with which this invention is especially concerned, such an accumulation would pose a very serious corrosion problem.

Figure 1:
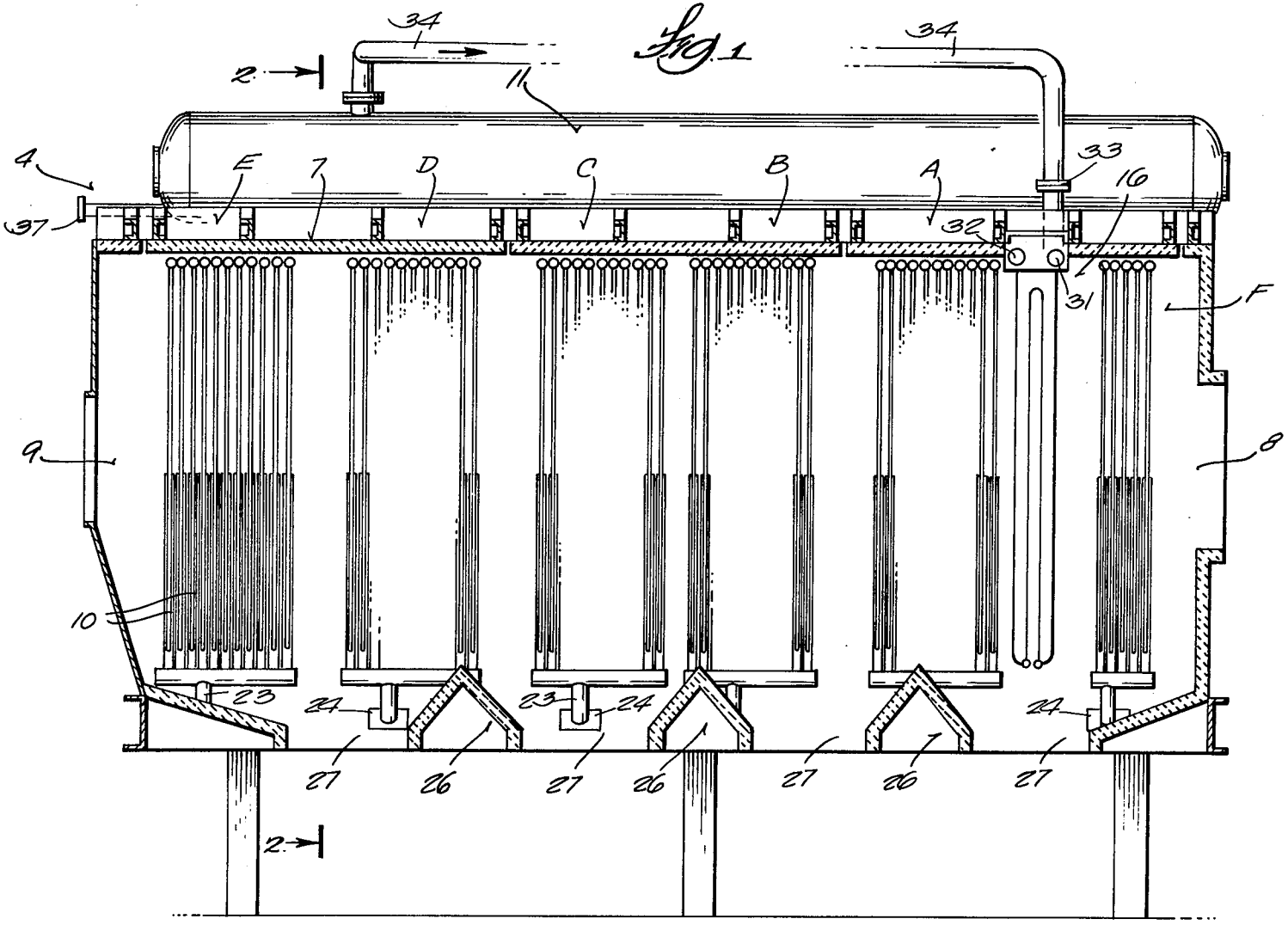
FIG. 1 is a longitudinal sectional view through a waste heat boiler constructed in accordance with this invention.
Figure 2:
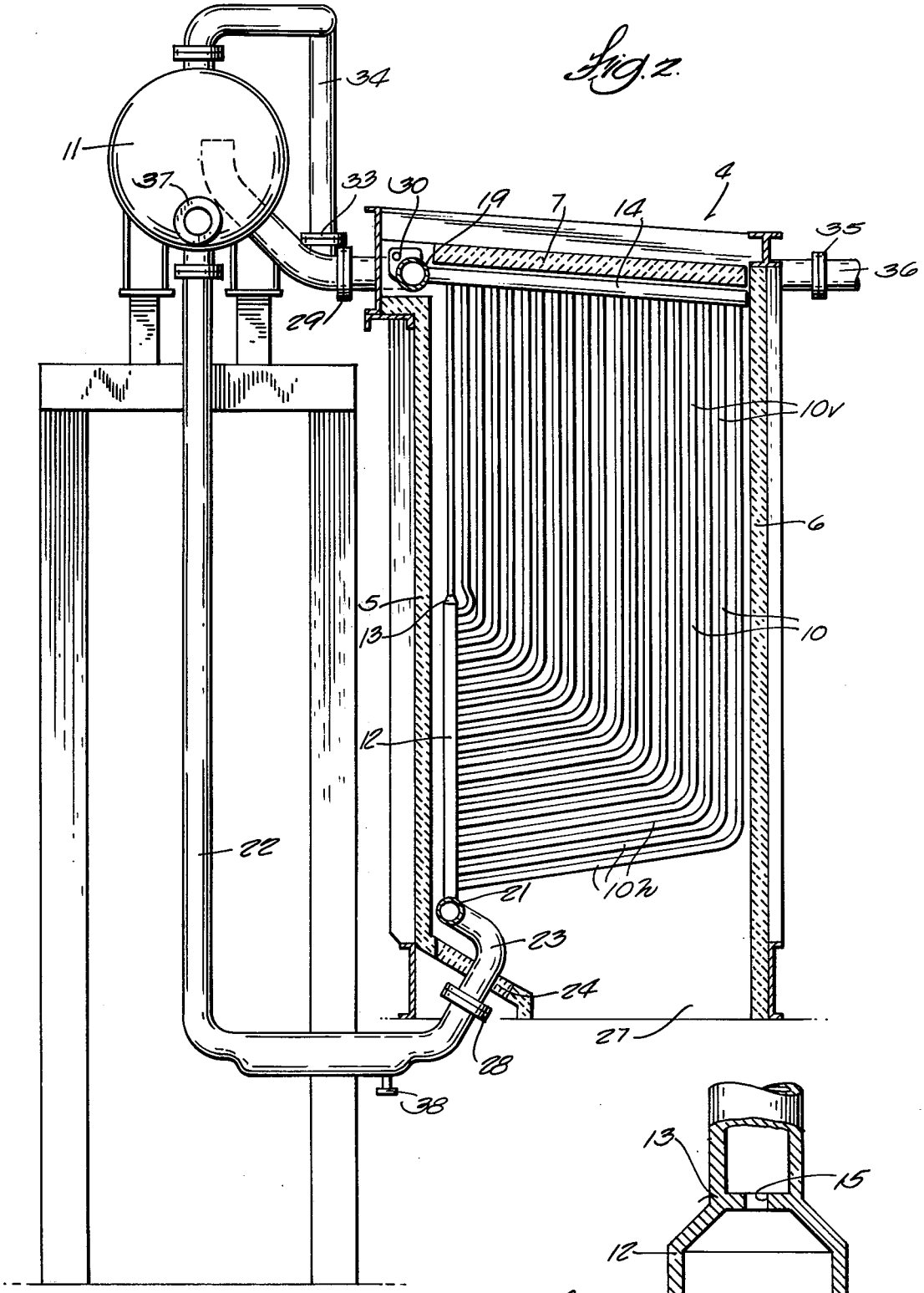
FIG. 2 is a cross sectional view through FIG. 1 on the plane of the line 2—2.
Figure 3:
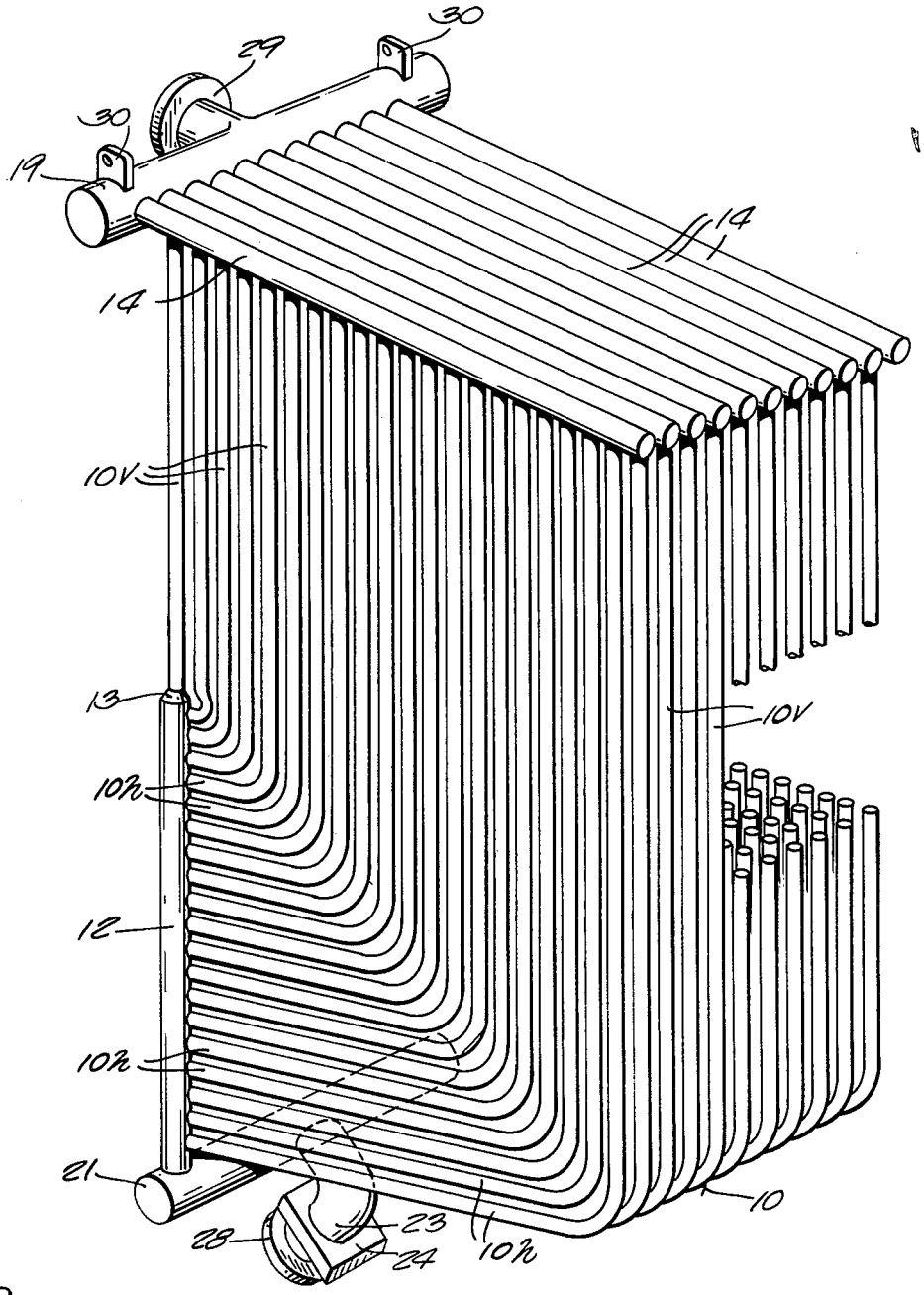
FIG. 3 is a perspective view of one of the tube bundles that collectively comprise the heating surfaces of the boiler.

To preclude the accumulation of solid particles on surfaces which would be deleteriously affected if the gaseous effluent from which heat is being abstracted contained chemicals that ruled out the use of prior waste heat boilers, all of the water tubes 10 are so shaped that by far the major surfaces thereof are vertical or substantially so, and devoid of encircling fins or other extended surface. Thus, as shown in FIGS. 2 and 3, the individual tubes are preferably L-shaped with a long vertical stretch 10v and a shorter almost horizontal stretch 10h. Moreover, the entire collection of tubes is arranged in rows that extend transversely across the gas pass and are spaced apart along the length of the gas pass, as shown in FIG. 1.

The tubes of each transverse row are nested one within the other, for which purpose they are of progressively different sizes. The lower ends of all of the tubes in a row—which, in each case, is of course the outer extremity of the almost horizontal stretch 10h—is welded to and connects with a vertical feeder header 12 below a reduction 13 in the diameter thereof. The diameter reduction 13 not only divides the header 12 into a large diameter lower portion that feeds all of the tubes connected therewith, and a smaller diameter upper portion that connects with a collecting header 14 that extends across the top of the row of tubes, but also serves as a constriction which diverts the flow of boiler fluid into the tubes. Hence boiler fluid that enters the lower ends of the tubes from the larger diameter lower portion of the feeder header 12 flows by natural circulation out of the vertical stretch 10v of the tubes into the collecting header 14 to which all of the tubes are joined.

Boiler fluid that enters the vertical feeder header 12, in excess of that accommodated by the L-shaped tubes 10 fed thereby, is conducted to the collecting header 14 by its small diameter upper portion.

Figure 4:
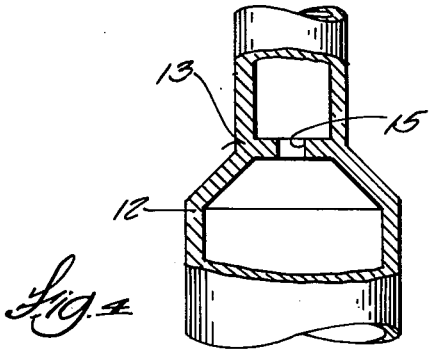
FIG. 4 is a fragmentary view illustrating an optional modification of a detail in the heating surfaces of the boiler.

If the restriction provided by the reduction in the diameter of the headers 12 is not sufficient to assure that the tubes 10 will be adequately fed with boiler fluid, an orifice plate 15 can be incorporated in the junction of the upper and lower portions of the headers 12, as shown in FIG. 4.

One of the most significant features of this invention resides in the fact that the entire collection of tubes is divided into discrete groups or bundles, all of which—with the exception of one which serves as a superheater 16—form steam generating surfaces. In the illustrated embodiment of the invention, five of the groups or bundles of boiler tubes, identified by the reference characters A, B, C, D and E, are identical in size, each consisting of eleven of the described rows of tubes. A sixth group or bundle F, which is located in the inlet end portion of the gas pass just upstream from the superheater 16, contains only five rows of tubes. While the number of rows of tubes in each group or bundle is not important and forms no part of the invention, the fact that all but two of the bundles are identical in every respect is very significant and, as will be hereinafter explained, achieves an unprecedented advantage in water tube boiler design.

The collecting headers 14 for all of the rows of tubes in every group or bundle are joined to and empty into a receiving header 19, and all of the receiving headers—which are coaxially positioned above the side wall 5 of the gas pass—are individually connected with and empty into the steam drum.

In like manner, the feeder headers 12 for all of the tows of tubes in every group or bundle of steam generating tubes, are joined to and receive boiler fluid from a distributing header 21. These distributing headers—like the receiving headers 19—are coaxial and each is individually connected with the steam drum below its waterline by an external downcomer pipe 22.

Note that the coaxial distributing headers 21 are just inside the lower portion of the side wall 5 of the gas pass, and that the connections thereof with their downcomer pipes includes a curved pipe section 23 that passes through an inwardly inclined lower portion 24 of the gas pass side wall 5.

The opposite side wall 6 of the gas pass may be flat from top to bottom, as shown in FIG. 2, and the lower portions of the side walls are structurally connected by transversely extending cross members 26. These cross members are spaced apart a considerable distance—in fact, so much so that open space 27 therebetween is so large that, for all intents and purposes, the bottom of the gas pass is essentially open. Hence, solid particles entrained in the gaseous medium flowing through the gas pass drop substantially unrestrictedly into ash bins (not shown) placed below the openings 27. To avoid the accumulation of solid particles or ash on the transversely extending cross members 26, they have an inverted V-shaped cross section, as shown in FIG. 1.

By virtue of the described shape of the water tubes that form the heating surfaces of the boiler, and the absence of a mud drum, the boiler can be kept reasonably clean by conventional soot blowers strategically located in the side walls of the gas pass; but, for more thorough cleaning, each group or bundle of tubes can be lifted out of the gas pass without disturbing the rest of the tubes.

To that end, the curved pipe sections 23 by which the distributing headers are connected with their respective downcomer pipes 22—as by a bolted flange coupling 28—as well as the parts of the inclined bottom section of the wall 5 through which the curved pipe sections pass, are arranged to be lifted from their normal positions. In like manner, the collecting header 19 of each group or bundle of tubes is separately connected with the steam drum by a bolted flange connection 29.

Hence, any selected group or bundle of tubes can be lifted from the gas pass upon undoing its bolted flange connections 28 and 29 with the steam drum, and of course removal of that portion of the roof 7 of the gas pass overlying the selected group or bundle of tubes. The details of the roof structure are of no consequence, though—for convenience, and as indicated before—it is of sectional construction with each section mating with its adjoining sections.

Lifting lugs 30 with eyes for the reception of hooks suspended from the cable of a crane, are suitably attached to each group or bundle of tubes.

Although the superheater 16 differs from the boiler tube groups or bundles in that all of its tubes are connected to and suspended from inlet and outlet headers 31 and 32 respectively, it too is adapted to be lifted from the gas pass without disturbing any of the other tubes. To that end, its inlet header 31 is separably connected as at 33 with a steam line 34 that leads from the steam drum and its outlet header 32 is separably connected as at 35 with a superheated steam delivery line 36.

As with conventional practice, the steam drum has a feed water inlet, indicated at 37, and the entire boiler with its appurtenances is suitably supported on its foundation.

Also as in conventional boilers, blow-off means are provided, but since there is no mud drum, the bottommost portion of each of the downcomers is provided with a blow-off valve 38. It is in fact this location of the blow-off valves which obviates the need for a conventional mud drum. Preferably the bottommost portion of the downcomers at which the blow-off valves are located is enlarged, as shown, to accommodate the sludge that may form in the boiler fluid.

It should, of course, be understood that the boiler must be shut down during removal and replacement of any group or bundle of tubes. The fact that all of the tube bundles, except the bundle F which forms the first boiler section and the superheater, are identical makes it possible to quickly replace any one of the majority of the tube bundles (A through E) that has been removed for thorough cleaning outside the boiler or for any other reason, with a spare tube bundle kept available at the job site. This, of course, obviates the need for doing any field repair work on the boiler pressure parts, and greatly minimizes the down time of the boiler and associated portions of the plant.

While the L-shaped configuration of the tubes as illustrated in FIGS. 2 and 3 has been found to be best adapted to the attainment of the purposes of the invention, that specific shape is not essential. Thus, as diagrammatically illustrated in FIG. 5, the tubes could be C-shaped or given any other suitable configuration having few, if any, horizontal portions, without too seriously increasing the possibility of particulate matter entrained in the gas stream accumulating on the heating surfaces. In the case of C-shaped tubes, the feeder headers 120 and the collecting headers 140 are coaxial and vertically disposed at the same time of the gas pass, and preferably mechanically connected.

Although as heretofore indicated, the water tubes are preferably devoid of extended surface, where it is needed the heating surface of the boiler can be significantly increased by providing the vertical portion of each tube with longitudinally extending wing-type fins 39, as depicted in FIG. 6. With the coplanar disposition of these fins, as shown, they project from the front and back of each tube and hence do not obstruct the gas flow; nor do they present surfaces upon which particulate matter in the gas stream can accumulate.

Those skilled in the art will appreciate that the invention can be embodied in forms other than as herein disclosed for purposes of illustraion.

The invention is defined by the following claims:

We claim:

1. A waste heat recovery boiler by which heat energy contained in a hot gaseous medium emanating from any source thereof is utilized in the production of steam, said boiler having:

(1) an elongated gas pass through which the hot gaseous medium flows, (2) a steam drum, and (3) heating surfaces comprising water tubes connected with the steam drum and distributed within the gas pass to indirectly transfer heat energy from the hot gaseous medium flowing through the gas pass to boiler fluid circulating through said tubes from and back to the steam drum, said heat recovery boiler being characterized in that:

A. the gas pass is substantially horizontally oriented and has side walls, a roof and an essentially open bottom;

B. the steam drum is wholly outside the gas pass in a parallel relation to and at an elevation near the top of the gas pass, but not thereabove, so that the steam drum does not interfere with access to and from the gas pass from thereabove;

C. the heating surfaces have a minimum of upwardly facing areas upon which solid particles entrained in the gaseous medium flowing through the gas pass can accumulate to be thereby kept from dropping through the essentially open bottom of the gas pass;

D. the water tubes are divided into groups, each of which groups has a distributing header at its bottom paralleling the gas pass with a connection pipe for receiving fluid from said steam drum, the distributing headers of the groups being aligned along a side of said gas pass, and each group also having a receiving header at its top paralleling the gas pass with a connection pipe for delivering fluid to said steam drum, the receiving headers being aligned along a side of said gas pass, whereby said groups are individually separably connected with the steam drum; and E. the roof of the gas pass has separately removable sections, removal of that one or those of which that lie above a selected group of tubes provides an opening through which the selected group of tubes can be lifted from the gas pass without disturbing the remainder of the tubes, upon disconnection of the selected group from the steam drum.

2. The waste heat boiler defined by claim 1, wherein the side walls of the gas pass have their lower portions connected by cross members that are spaced apart along the length of the gas pass to provide relatively large openings in the bottom of the gas pass which collectively render the bottom of the gas pass essentially open, and the upwardly facing surfaces of said cross members being shaped to prevent the accumulation of solid particles thereon.

3. A waste heat recovery boiler by which heat energy contained in a hot gaseous medium emanating from any source thereof is utilized in the production of steam, said boiler having:

(1) an elongated gas pass through which the hot gaseous medium flows;

(2) a steam drum; and (3) heating surfaces comprising water tubes connected with the steam drum and distributed within the gas pass to indirectly transfer heat energy from the hot gaseous medium flowing through the gas pass to boiler fluid circulating through said tubes from and back to the steam drum;

said heat recovery boiler being characterized in that:

A. the gas pass is substantially horizontally oriented and has side walls, a roof and an essentially open bottom;

B. the steam drum is wholly outside the gas pass at an elevation near the top of the gas pass but not thereabove so that the steam drum does not interfere with access to and from the gas pass from thereabove;

C. the heating surfaces have a minimum of upwardly facing areas upon which solid particles entrained in the gaseous medium flowing through the gas pass can accumulate to be thereby kept from dropping through the essentially open bottom of the gas pass;

D. the water tubes are divided into groups or bundles, each of which is individually separably connected with the steam drum; and E. the roof of the gas pass has separately removable sections, removable of that one or those of which that lie above a selected group or bundle of tubes provides an opening through which the selected group or bundle of tubes can be lifted from the gas pass without disturbing the remainder of the tubes, upon disconnection of the selected group or bundle from the steam drum;

each group or bundle of water tubes comprises:

A. a number of rows of adjacent tubes every one of which has an upper end and a lower end;

B. a feeder header for each row of tubes joined to the lower ends of all of the tubes in its row;

C. a collecting header for each row of tubes joined to the upper ends of all of the tubes in its row;

D. a distributing header joined to the feeder headers for the tubes comprising its respective group of tubes and connected with the steam drum to receive boiler fluid therefrom;

E. a receiving header joined to the collecting headers for the tubes comprising its respective group of tubes and connected with the steam drum to deliver boiler fluid thereto;

and which waste heat boiler is further characterized by:

A. means mounting the collecting headers and said receiving headers substantially directly under the roof of the gas pass with the collecting headers extending transversely across the gas pass so that the rows of tubes joined thereto also extend transversely across the gas pass and depend from their collecting headers; and B. means mounting the feeder headers and the distributing headers adjacent to the inner surface of one of the side walls of the gas pass with the feeder headers extending substantially vertically upwardly from the distributing headers and with the distributing headers substantially horizontal but contiguous to said side wall of the gas pass.

4. The waste heat boiler defined by claim 3, wherein all of said water tubes are substantially L-shaped and have vertically and substantially horizontally oriented stretches, the upper ends of the tubes being at the top of their vertically oriented stretches and the lower ends thereof being at the outer extremities of their substantially horizontally oriented stretches, and the tubes of each row thereof being nested one within the other and collectively being substantially uniformly distributed transversely across the gas pass.

5. A waste heat recovery boiler by which heat energy contained in a hot gaseous medium is utilized for the production of steam, said boiler having means defining an elongated gas pass through which hot gaseous medium flows, a steam drum, and water tubes connected with the steam drum and located in the gas pass for indirect transfer of heat energy from the hot gaseous medium to boiler fluid which circulates through said tubes from and back to the steam drum, said boiler being characterized by:

A. the gas pass (1) having its length oriented substantially horizontally and (2) having side walls and a roof but having a substantially open bottom through which particulate matter entrained in gaseous medium flowing through the gas pass can drop substantially unrestrictedly for collection;

B. the steam drum (1) being wholly outside the gas pass and (2) being located at an elevation above the gas pass but at one side thereof so that the steam drum does not interfere with access to the roof of the gas pass;

C. downcomers opening from the bottom of the steam drum and extending downwardly therefrom at the exterior of the gas pass, for conducting liquid boiler fluid from the steam drum to the water tubes, said downcomers having bottom end portions spaced at intervals along the length of the gas pass, near the elevation of the bottom thereof;

D. the water tubes being arranged in groups, there being a group of tubes for each downcomer, (1) every tube of each group having a lower end that has a connection with the bottom end portion of its downcomer, (2) every tube of each group having an upper end which is near the roof of the gas pass and has a connection with the steam drum, and (3) every tube, along a major portion of its length, extending at a substantial angle to the horizontal so that the water tubes do not present surfaces of substantial area upon which particles entrained in gaseous medium flowing through the gas pass can accumulate.

6. The waste heat boiler of claim 5, further characterized by:

each of said downcomers having a valved blow-off in its said bottom end portion.

7. The waste heat boiler of claim 5, further characterized by:

A. the roof of the gas pass comprising separately removable sections so that each bundle of tubes can be lifted from the gas pass without disturbing the remainder of the tubes; and B. all of the tubes of each group having the lower end thereof connected to a distributing header which is in turn detachably connectable with the downcomer for the group of tubes, and having the upper end thereof connected to a collecting header which is in turn detachably connectable with the steam drum, whereby any selected group of tubes may be lifted from the gas pass upon detachment of its distributing header from its downcomer and detachment of its collecting header from the steam drum, providing the roof section or sections above the selected group of tubes is removed.

8. The waste heat boiler of claim 7, wherein the majority of said groups of water tubes are identical in all respects so that any one of said majority of groups can be replaced with another identical spare group of tubes.

* * * * *

UNITED STATES PATENT OFFICE
CERTIFICATE OF CORRECTION

PATENT NO. : 4,188,916

DATED : February 19, 1980

INVENTOR(S) : Denis G. Csathy and Wendell L. Y. Hung

It is certified that error appears in the above-identified patent and that said Letters Patent are hereby corrected as shown below:

Column 1, line 11, after "waste" ---heat--- should appear

Column 1, line 36, after "and" ---in--- should appear

Column 5, line 25, "time" should read ---side---

Signed and Sealed this

*Twenty-seventh* Day of *May 1980*

[SEAL]

*Attest:*

SIDNEY A. DIAMOND

*Attesting Officer*

*Commissioner of Patents and Trademarks*